US005520869A

United States Patent [19]

Taylor

[11] Patent Number: 5,520,869

[45] Date of Patent: May 28, 1996

[54] TREATMENT OF FIBRE

[75] Inventor: James M. Taylor, Derby, United Kingdom

[73] Assignee: Courtaulds PLC, United Kingdom

[21] Appl. No.: 323,059

[22] Filed: Oct. 14, 1994

Related U.S. Application Data

[63] Continuation of Ser. No. 30,253, filed as PCT/GB91/01776, Oct. 11, 1991 published as WO92/07124, Apr. 30, 1992, abandoned.

[30] Foreign Application Priority Data

Oct. 12, 1990 [GB] United Kingdom ..... 9022175

[51] Int. Cl.[6] ..... D06M 23/00; D06M 15/39; D06M 15/356; D01F 2/00

[52] U.S. Cl. ..... 264/203; 264/211.14; 264/211.15; 8/188

[58] Field of Search ..... 428/393; 8/115.5, 8/115.6, 188, 189; 264/211.14, 211.15, 203

[56] References Cited

U.S. PATENT DOCUMENTS

| | | | |
|---|---|---|---|
| 3,849,169 | 11/1974 | Cicione et al. | 8/184 |
| 4,371,517 | 2/1983 | Vanlerberghe et al. | 8/127.51 |

FOREIGN PATENT DOCUMENTS

| | | |
|---|---|---|
| 40668/78 | 4/1980 | Australia . |
| 1148892 | 12/1957 | France . |
| 1158775 | 6/1958 | France . |
| 2407280 | 5/1979 | France . |
| 2450293 | 9/1980 | France . |
| 53-035017 | 4/1978 | Japan . |
| 810352 | 3/1959 | United Kingdom . |
| 1142428 | 2/1969 | United Kingdom . |
| 2043525 | 10/1980 | United Kingdom . |

OTHER PUBLICATIONS

"Rayon", *Encyclopedia of Polymer Science and Engineering*, vol. 14, pp. 45–46, 57–59, John Wiley & Sons, Inc. (1988).

"Textile Resins", *Encyclopedia of Polymer Science and Engineering*, vol. 16, pp. 684 and 685, John Wiley & Sons, Inc. (1989).

P. Pavlov et al, "Properties of Viscose Fibres Modified in an As–spun State by Cross–Linking", *J. Textile Institute*, 78(5):357–361 (1987).

*Primary Examiner*—Jeffrey Mullis
*Attorney, Agent, or Firm*—Howson and Howson

[57] ABSTRACT

Regenerated cellulose fiber with a reduced tendency to fibrillation can be prepared by treating never-dried fiber with an aqueous solution or dispersion of a polymer having a plurality of cationic ionisable groups. Suitable polymers include those carrying imidazoline and azetidinium groups. The fiber may additionally be treated with an aqueous emulsion of an emulsifiable polymer.

14 Claims, 1 Drawing Sheet

TREATMENT OF FIBRE

This is a continuation of application Ser. No. 08/030,253, filed as PCT/GB91/01776, Oct. 11, 1991, published as WO92/07124, Apr. 30, 1992, (now abandoned).

TECHNICAL FIELD

This invention relates to the treatment of fibre and has particular relevence to the treatment of solvent-spun regenerated cellulose fibre.

BACKGROUND ART

Proposals have been made to produce regenerated cellulose fibre by spinning a solution of cellulose in a suitable solvent. An example of such a process is described in UK Patent Specification 2043525, the contents of which are incorporated herein by way of reference. In such a solvent spinning process, cellulose is dissolved in a solvent such as a tertiary amine N-oxide, e.g. N-methylmorpholine N-oxide, which is a solvent for the cellulose. The solution is then spun through a suitable die to produce filaments, which are washed in water to remove the solvent. The fibres may be stretched during the processing, both before and after washing as required. Typically, the fibre is then treated with a finish before being utilised in a known manner.

The present invention is particularly concerned with the treatment of such solvent-spun cellulose fibre so as to reduce the tendency of the fibre to fibrillate. Fibrillation is the breaking up in a longitudinal mode of the fibre to form a hairy structure. A practical process to reduce fibrillation needs not only to reduce fibrillation itself, but also to have a minimal effect on subsequent dyeability of the fibre and to have as little effect as possible on tenacity and extensibility of the fibre. Processes have been investigated which will reduce fibrillation but these unfortunately reduce the tenacity and the extensibility of the fibre. Other processes have been investigated which, while not reducing tenacity and extensibility, have a deleterious effect on the dyeability of the fibre.

The present invention addresses the need for a process which not only reduces fibrillation tendency but also yields a treated fibre which has a significantly reduced tendency to fibrillate without significant reduction in tenacity and extensibility and without significant deleterious effect on dyeability. Maintaining a balance between all of the required properties of the fibre is extremely difficult because it is not sufficient to produce a fibre with a low tendency to fibrillation but which has a very low tenacity or a very low extensibility or a very poor dyeability. It would also be unsatisfactory to produce a fibre which was so rigid as to be unworkable or so embrittled as to be unprocessable.

DISCLOSURE OF INVENTION

A method according To the invention of manufacturing regenerated cellulose fibre with a reduced tendency to fibrillation is characterised in that never-dried regenerated cellulose fibre is treated with an aqueous solution or dispersion of a polymer having a plurality of cationic ionisable sites. Never-dried fibre is regenerated fibre which has been washed after regeneration in preparation for drying but which has not yet been dried. Never-dried fibre has different physical properties from fibre which has been dried and rewetted; for example it generally has a higher water imbibition.

A regenerated cellulose fibre according to the invention is characterised in that it bears a coating which comprises a polymer having a plurality of cationic ionisable sites. The coating may optionally comprise in addition an emulsifiable polymer.

The regenerated cellulose fibre according to the invention is preferably a solvent-spun fibre prepared by a method including the steps of:

(i) dissolving cellulose in a water-miscible solvent to form a dope;

(ii) extruding the dope to form extruded filaments;

(iii) passing the extruded filaments into water to remove solvent and form regenerated cellulose fibre;

(iv) treating the resulting wet fibre in never-dried state with an aqueous solution or dispersion of a polymer according to the method of the invention; and (v) drying the resulting treated fibre.

The wet fibre is optionally treated in addition with an aqueous emulsion of an emulsifiable polymer so as to exhaust the emulsifiable polymer onto the wet fibre. The wet fibre may be treated with a mixture of water-soluble or water-dispersible polymer having a plurality of cationic ionisable sites (herein "polyelectrolyte") and aqueous emulsion of emulsifiable polymer. The mixture may further include glyoxal as a cross-linking agent. The mixture may further include a catalyst to enhance the cross-linking of the glyoxal.

Typically the fibre is treated to give a total of 0.1 to 1.0% solids by weight of dry fibre on the fibre. The weight of solids may be in the range 0.2 to 0.8% or 0.3 to 0.6% or 0.4 to 0.5%, based on dry fibre.

The fibre may be treated by padding, in which the fibre is brought into contact with a surface carrying the treatment solution, or by immersion and exhaustion.

The fibre may be treated with conventional finishes between the step of passing into water to remove solvent and the treatment with the polyelectrolyte or after that treatment.

When an emulsifiable polymer is used, the polyelectrolyte and the emulsifiable polymer may be mixed together for simultaneous treatment of the cellulosic fibrous material, or the cellulosic material may be first treated with the polyelectrolyte and then treated with the emulsifiable polymer.

A preferred class of polyelectrolytes is that comprising polymers (e.g. having a molecular weight of from 20,000 to 10,000,000 viscosity average) having a backbone exclusively of carbon atoms to which are attached units of the formula:

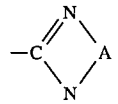

H where A is a $C_2$ to $C_3$ alkylene group in which different carbon atoms are linked to the two nitrogen atoms. Such polymers may be prepared by reacting a di- or poly-amine with a polymer of a nitrile-group-containing monomer. When A is a $C_2$ alkylene group the units are imidazoline units. A particularly preferred polyelectrolyte of this class is that sold under the Trade Mark "Primafloc C7", which is believed to be a poly(vinylimidazoline) in the class just described. Alternatively, polyelectrolytes based on polyacrylamides or water soluble polyamides may be used.

A particularly preferred class of polyelectrolytes is that in which at least some of the cationic ionisable sites are azetidinium cations. Such sites can be formed by reaction of a secondary amine group with an epihalohydrin, for example epichlorhydrin. Polymers containing secondary amine groups can be prepared for example by condensation of a diacid, for example adipic acid, with a compound which contains two primary amine groups and at least one secondary amine group, for example diethylenetriamine. Such a condensation yields a polyamide containing secondary amine groups. One suitable polymer having a plurality of cationic ionisable sites of this class is sold by Hercules Powder Corporation under the Trade Mark "Hercosett 125". Another suitable polymer is sold by the Stephenson Group under the Trade Mark "Listrilan SR".

The use of polymers which incorporate azetidinium cations, in particular Hercosett 125, as dyeing aids for cotton is described by S. M. Burkinshaw et al. in Journal of the Society of Dyers and Colourists, Volume 105 (1989), pages 391–398, and Volume 106 (1990), pages 307–315. Although it was noted that the use of such dyeing aids did not significantly affect the tensile properties of cotton fabrics, there was no suggestion that such use might have any effect on the properties of the fibres, in particular their tendency to fibrillate. Cotton fibres indeed have little tendency to fibrillate. This may be related to the fact that they have a complex morphology based on the cellulose I structure, whereas solvent-spun regenerated cellulose fibres have a relatively simple morphology based on the cellulose II structure. There is furthermore no suggestion that such polymers would be of value when applied to never-dried regenerated cellulose fibres, rather than to cotton fibres immediately prior to dyeing.

A wide variety of polymers may be used as the optional emulsifiable polymer in the method of the invention, the essential requirement simply being that the polymer should be emulsifiable in water. Suitable polymers include polyacrylates, polyvinyl acetates and copolymers of vinyl acetate, polyolefins and particularly polyethylenes. Polyethylene emulsions sold under the Trade Mark "Bradsyn P.E." (Hickson & Welch), under the Trade Mark "Iberlene P.E." (Harrison Chemicals), under the Trade Mark "Mykon SF" (Warwick Chemicals), vinyl acetate copolymer emulsions sold under the Trade Marks "Vinamul 6000 and "Vinamul 6515" (Vinyl Products) and polyvinyl acetate emulsion sold under the Trade Mark "Calatac VB" (I.C.I.) may be used. In the case of polyethylene emulsions, the polymer should preferably have a melting point of about 100°–105° C., a molecular weight below about 5000, an acid number of under 20 and a carbonyl content of not more than 1% >C=0 by weight.

An emulsifying agent is often necessary to emulsify the polymer, and a nitrogen-free non-ionic emulsifying agent such as poly(ethylenoxyalkylphenol) may be used.

The aqueous polymer emulsion may be cationic, non-ionic or anionic, but a non-ionic polymer emulsion may be preferred.

The pH of the emulsion may be in the range 4 to 7, particularly from 5 to 6. The emulsion should be rather dilute, and will generally contain considerably less than 1% by weight solids. Under favourable conditions, exhaustion is rapid and complete; completion of the process can be readily observed because the liquor, which is initially turbid, becomes completely clear after the fibre has been immersed in the treatment liquor.

Temperatures in the range 20° C. to 60° C., e.g. 25° C. to 30° C., are preferred as treatment temperatures.

The concentrations of the polyelectrolyte and of the optional emulsifiable polymer in the treatment liquor are chosen having regard to the amount of solids desired on the fibre and to the type of equipment to be used for the treatment. The concentration of polymer solids in the treatment liquor may for example be 1–25 g/l, more preferably 5–20 g/l, most preferably 10–15 g/l. The treatment bath may optionally also contain a crosslinking agent such as glyoxal. When used, the crosslinking agent is preferably present in the bath at a concentration of 2 to 10 g/l, more preferably 4 to 8 g/l. The treatment bath may additionally contain a catalyst for the crosslinking reaction, for example that sold by BASF under the Trade Mark "Condensol FB".

The amount of polyelectrolyte deposited onto the fibre may be from 0.05% to 1.0%, preferably 0.1% to 0.5%, by weight on the weight of the fibre. When used, the amount of emulsifiable polymer that is exhausted onto the fibre may be from 0.1% to 4.0%, preferably 0.75% to 2.0%, by weight.

The term "exhaustion" has been used to describe the transfer of disperse phase particles from an emulsion or suspension (without breaking the emulsion or suspension) to the fibre immersed in it or to which the emulsion is applied; it is not intended to imply that the process must necessarily be complete (i.e. that the supply of the disperse phase particles must necessarily be exhausted) although complete exhaustion will generally be convenient in batch operation in providing automatic control over the amount of polymer deposited.

After exhaustion has taken place, excess liquor is removed from the treated fibre by hydroextraction, for example by centrifuging or mangling, and the regenerated cellulosic fibre is then dried, preferably at a temperature of about 80°–100° C.

When the process of this invention is performed as a batch operation, the fibres are simply immersed in the treatment bath or baths containing the treatment liquors. The liquor to fibre ratio in the bath is in no way critical to the invention. Liquor to fibre ratios of from 5:1 to 100:1, e.g. 30:1, may be found convenient.

Alternatively, the process may be carried out continuously on a continuous length of fibre. The continuous treatment may best be carried out using a pad mangle, although application may be made from baths of a conventional backwasher. In either case it is essential that during or after the impregnation step, a sufficient degree of exhaustion of polymer onto the fibre to reduce the fibrillation tendency should occur before the treated goods are subjected to further stages of processing, e.g. rinsing, treating with other agents or drying. The time for the exhaustion to occur will depend both on the mixture of the polymer and the properties of the fibre being treated, but should not normally exceed 15 minutes. The exact times and conditions may readily be determined by experiment.

When the regenerated cellulose fibre is a solvent-spun fibre, the solvent is preferably a tertiary amine N-oxide and is further preferably N-methylmorpholine N-oxide.

BRIEF DESCRIPTION OF DRAWINGS

By way of example, embodiments of the present invention will now be described with reference to the accompanying drawings, of which.

Figure 1:
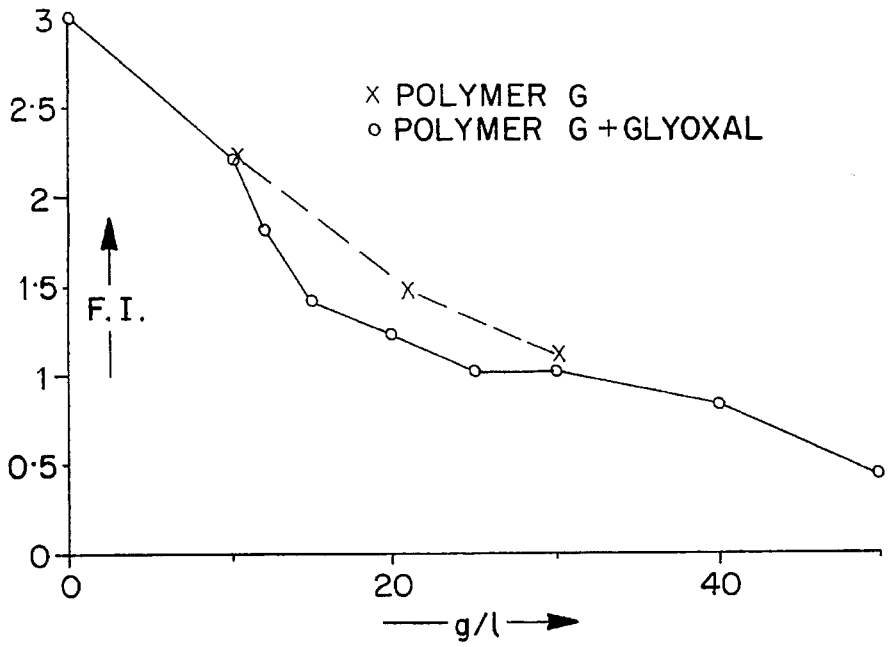
FIG. 1 is a graph of Fibrillation Index (F.I.) against concentration.

It will be appreciated that the method described in this specification is somewhat similar to the process described in British Patent Specification 1340859 which specification describes a process for treating wool in order to render it shrink-resistant. It is not known why a process for treating wool to render it shrink resistant should be suitable for treating never-dried regenerated cellulose fibre to render it resistant to fibrillation whilst still permitting the cellulose fibres to retain adequate tenacity extensibility and dyeability. It will further be appreciated that there are vast numbers of processes for the treatment of fibres in existence and it is not practical or possible to predict the effects of the treatment of a proteinacious fibre such as wool when compared to a regenerated cellulosic fibre such as solvent spun regenerated cellulose.

EXAMPLE

To carry out a series of tests, a plurality of cellulose strands were extruded from a solution of cellulose in N-methylmorpholine N-oxide and passed into a water bath to remove the solvent. The fibre thus produced was then passed through one of a number of treatment baths having a variety of chemical compositions (Baths 1–12) and through a spin-finish bath to apply conventional spin-finishes.

Details of the treatment bath contents, which incorporate an essential element of the invention, are given below.

The cellulosic fibre treated with different treatment baths was then processed into yarn by conventional spinning techniques, and subsequently yarn samples were dyed on a small scale by a process which simulates large scale dyeing.

The details of the dyeing of the fibre samples were as follows:

2 g of fibre was first placed in a stainless steel cylinder approximately 25 cm high by 4 cm diameter. The cylinder had a capacity of approximately 250 ml, and at each step in the treatment 50 ml of solution was added to the 2 g of fibre.

The first step was to scour the fibre to remove the spinning lubricant. A conventional scouring solution of anionic detergent and $Na_2CO_3$ at 94° C. was added to the fibre, a screw cap was applied, and the capped cylinder was tumbled end over end for 45 minutes at about 60 tumbles per minute.

The scouring solution was then removed, and the fibres were washed in water and bleached for 1 hour at 95° C. Again the cylinder was capped and tumbled at 60 tumbles per minute.

The bleaching solution used contained:

7.5 cc/liter $H_2O_2$ (at 35% concentration)

1 g/l NaOH 1 g/l of a peroxide stabiliser and heavy metal sequestrant ("Contivan SNT" available from CHT Products Limited)

After bleaching, the fibres were washed and dyed using 4% Procion Navy HER 150 reactive dye ("Procion" is a Trade Mark of Imperial Chemical Industries plc). Dyeing took place at 80° C. in the capped cylinder in an aqueous solution containing 80 g/l Nacl and 20 g/l $Na_2CO_3$. Again the cylinder was tumbled end over end at 60 tumbles per minute.

After dyeing, the fibres were washed and dried. The fibres were then assessed for the amount of fibrillation, the dyeability of the fibre, fibre tenacity, fibre extensibility and water imbibition.

To measure the fibrillation and to fix a scale so that changes in fibrillation could be determined, a series of fibres having a range of degree of fibrillation from zero upwards was identified. A standard length of fibre was then taken and the number of fibrils (fine hairy spurs extending from the main body of the fibre) along the standard length was counted. The length of each fibril was measured, and an arbitrary number, being the product of the number of fibrils multiplied by the average length of each fibril, was determined for each fibre. The fibre in this series having the highest such number was then identified as the most fibrillated fibre and was assigned the arbitrary Fibrillation Index of 10. The wholly unfibrillated fibre was assigned a Fibrillation Index of zero, and the remaining fibres were evenly ranged from 1 to 10 based on the microscopically measuremered arbitrary numbers. As a guide, the fibrils on a fibre having Fibrillation Index 1 are just visible to the eye.

The measured fibres were then used to establish an optical scale. To determine the Fibrillation Index for any other fibres, a sample of five or ten fibres was visually compared under the microscope with the set of graded fibres. The visually determined numbers were then averaged to give a Fibrillation Index for fibres having received a given treatment. It will be appreciated that visual comparison and averaging is many times quicker than measurement, and it has been found that skilled fibre technologists are consistent in their rating of the fibres.

Tenacity (in centinewton/tex) and extensibility (in per cent) were measured using conventional equipment, and again measurements were made on several fibres (usually ten) and the arithmetic mean calculated.

Dyeability was determined by visual comparison.

Solvent-spun cellulose not treated in accordance with the invention, i.e. not having had the treatment referred to above between the water bath and the application of the spin finish, has the following typical properties:

Fibrillation Index 3

Tenacity 40–42 cN/tex

Extensibility 13–15%

Good Dyeability (N.B. all dyeability tests referred to below are simply visual comparisons with untreated fibre.)

In a first series of tests to determine the effect of using the treatment of the invention, a mixture of a commercially available product "Polymer G" from Precision Processes (Textiles) Limited, glyoxal and a cross-linking catalyst was used in the treatment bath. Polymer G is believed to be an aqueous mixture comprising a solution of poly(vinylimidazoline) at a concentration of 0.1% by weight and an emulsion of non-ionic polyethylene at a concentration of 1% by weight.

A series of treatment baths was made up as set out in Table 1 below; the concentration referred to is in g/l of the aqueous Polymer G and the glyoxal in the treatment bath. The Fibrillation Index was measured as set out above. The treatment bath also contained a cross linking catalyst for the glyoxal, at a level of 25% of the glyoxal concentration. Typically "Condensol FB" (Trade Mark of BASF AG) was used as the catalyst; this is believed to be a composition of magnesium chloride and zinc fluoroborate.

TABLE 1

| | Polymer G Concentration | Glyoxal Concentration | Fibrillation Index |
|---|---|---|---|
| Bath 1 | 0 | 0 | 3 |
| Bath 2 | 10 | 2 | 2.2 |
| Bath 3 | 12 | 2.4 | 1.75 |
| Bath 4 | 15 | 3 | 1.4 |
| Bath 5 | 20 | 4 | 1.2 |
| Bath 6 | 25 | 5 | 1 |

TABLE 1-continued

| | Polymer G Concentration | Glyoxal Concentration | Fibrillation Index |
|---|---|---|---|
| Bath 7 | 30 | 6 | 1 |
| Bath 8 | 40 | 8 | 0.8 |
| Bath 9 | 50 | 10 | 0.5 |

The information contained in Table I is displayed graphically in FIG. 1. It can be seen that the improvement obtained in Fibrillation Index levels out above a concentration of about 20 g/l Polymer G plus 4 g/l glyoxal.

In a further series of baths, Polymer G alone was used as the treatment at varying concentrations. The results of these trials are given in Table II.

TABLE II

| | Polymer G Concentration g/l | Fibrillation Index |
|---|---|---|
| Bath 10 | 10 | 2.2 |
| Bath 11 | 20 | 1.5 |
| Bath 12 | 30 | 1.1 |

These results are also displayed graphically in FIG. 1.

Tenacity and extensibility tests were then carried out on the fibres treated with: 10 g/l Polymer G plus 2 g/l glyoxal and 0.5 g/l catalyst; 20 g/l Polymer G plus 4 g/l glyoxal and 1 g/l catalyst; and 30 g/l Polymer G plus 6 g/l glyoxal and 1.2 g/l catalyst. The results of these tests are given in Table III.

TABLE III

| | Polymer G Concentration g/l | Tenacity cN/tex | Extensibility % |
|---|---|---|---|
| Untreated | 0 | 40–42 | 13–15 |
| Bath 10 | 10 | 39.7 | 14.7 |
| Bath 11 | 20 | 38.2 | 14.3 |
| Bath 12 | 30 | 41.4 | 15.7 |

Fibres treated with Polymer G alone at a concentration of 25 g/l had a tenacity of 40.2 cN/tex and an extensibility of 16.4%.

Figure 2:
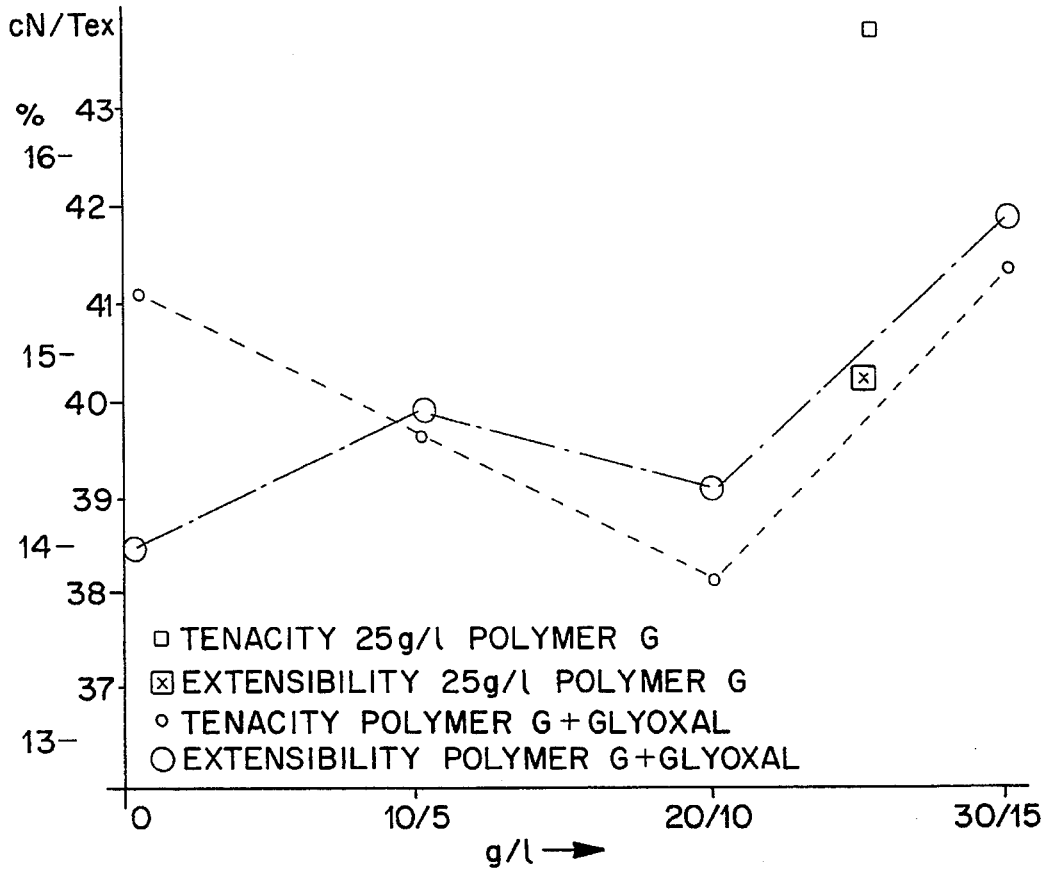
FIG. 2 is a graph of tenacity and extensibility against treatment bath concentration.

The tenacity and extensibility figures are plotted in FIG. 2, and it can be seen that the treatments of the invention give rise to little change in either tenacity or extensibility.

Visually there was no difference in the dyed colour of the treated fibres at any of the concentrations of Polymer G/glyoxal and catalyst compared to untreated fibre.

As a measure of comfort of the fibre in use, water imbibition tests were carried out. Cotton, normally considered a comfortable fibre, has a water imbibition of 50%. A control sample and the treated fibres of the invention gave the results shown in Table IV:

TABLE IV

| | Water Imbibition % |
|---|---|
| Untreated Fibre | 65 |
| 20 g/l Polymer G plus 4 g/l glyoxal and catalyst | 59.9 |
| 40 g/l Polymer G plus 4 g/l glyoxal and Catalyst | 56.5 |
| 20 g/l Polymer G | 63 |
| 40 g/l Polymer G | 61.7 |
| Cotton | 50 |

It can be seen, therefore, that the invention provides a treatment which reduces fibrillation (which causes pilling of cloth and gives unwanted hairiness to the cloth and unwanted visual effects to cloth made of very fibrillated fibres), whilst not affecting to any significant amount dyeability, tenacity, extensibility or water imbibition.

The properties present in combination in fibre treated by the preferred embodiments of the invention might almost be thought to be mutually exclusive—for example it might be thought that adding a material to the fibre which links into the fibre in some way so as to reduce fibrillation might affect dyeability or extensibility but this has been found not to be true with the method of the invention. Not only are these properties preserved but the fibre is processable into sliver, yarn and fabric. The treatment of the invention is able to do all this and still resist the scouring, bleaching and dyeing treatments.

Other suitable compositions for the treatment baths include:

(1) 1% solids by weight of the fibre of non-ionic polyethylene emulsion (Bradsyn P.E.); 0.1% solids by weight of the fibre of polyelectrolyte ("Primafloc C7", a Trade Mark of Rohm and Haas Limited); at a 30:1 liquor to fibre ratio; at a pH of 5.0 for 15 minutes at 40° C. The pH was adjusted to 5.0 by addition of 10% (w/v) orthophosphoric acid.

(2) 75 grams solids per liter of non-ionic polyethylene emulsion (Iberlene P.E.); and 1.0 grams solids per liter of polyelectrolyte (Primafloc C7); at 40° C.

EXAMPLE 13

Cellulose fibre was prepared as described in Example 1. The treatment bath was a 100 g/l solution in water of a polyamide epichlorhydrin resin sold by Hercules Inc. as a 12.5% aqueous solution under the Trade Mark "Hercosett 125". The best results were obtained when the pH of the bath was controlled at about 7.3–7.9. The results at this pH range, in comparison with a control sample, were as follows:

| | Control | Hercosett-treated |
|---|---|---|
| Fibrillation Index | 3.8 | 1.3 |
| Tenacity cN/tex | 42.3 | 41.2 |
| Extensibility % | 14.9 | 14.5 |
| Water Imbibition % | 56 | 56 |

EXAMPLES 14 AND 15

Cellulose fibre was prepared as described in Example 1. The treatment baths used were:

| | | |
|---|---|---|
| Bath 14 | 30 g/l | Polymer VG |
| | 6 g/l | glyoxal |
| | 4 g/l | Consensol FB |
| Bath 15 | 30 g/l | Polymer VG |

"Polymer VG" (Trade Mark) is available from Precision Processes (Textiles) Limited. It is believed to be an aqueous solution of 0.1% by weight poly(vinylimidazoline). The results were as follows:

| | Bath 14 | Bath 15 |
|---|---|---|
| Fibrillation Index | 1.1 | 1.3 |
| Tenacity CN/tex | 39.2 | 41.6 |
| Extensibility % | 14.8 | 14.4 |

I claim:

1. A method of manufacturing solvent-spun cellulose fibre with a reduced tendency to fibrillation, said method including the steps in sequential order of:

(i) dissolving cellulose in a water-miscible tertiary amine oxide solvent to form a dope;

(ii) extruding said dope through a die to form extruded filaments;

(iii) passing said extruded filaments into water to remove said water-miscible tertiary amine oxide therefrom, thereby forming never-dried solvent-spun cellulose fibre;

(iv) treating said never-dried solvent-spun cellulose fibre with an aqueous solution or dispersion of a cationic polymer selected from the group consisting of:

(a) polymers which have a backbone consisting exclusively of carbon atoms, to carbon atoms of said backbone being attached units of the formula:

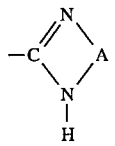

where A is a $C_2$ to $C_3$ alkylene group in which different carbon atoms are attached to the to nitrogen atoms, and (b) polymers which comprise azetidinium cations; and in which the aqueous solution or dispersion additionally contains a crosslinking agent in which the crosslinking agent is other than any material used to produce the cationic polymers; and (v) drying said never-dried solvent-spun cellulose fibre, thereby providing said solvent-spun cellulose fibre.

2. A method according to claim 1, wherein said cationic polymer comprises azetidinium cations and is prepared by condensation of a diacid with a compound containing two primary amine groups and at least one secondary amine group, followed by reaction with an epihalohydrin.

3. A method according to claim 1, wherein the fibre is so treated as to deposit 0.1 to 0.5 per cent by weight of said cationic polymer on the fibre.

4. A method according to claim 1, wherein said solvent is N-methylmorpholine-N-oxide.

5. A method according to claim 1, wherein said cross linking agent is glyoxal.

6. A method according to claim 5, wherein said aqueous solution or dispersion contains 1 to 10 grams of glyoxal per liter.

7. A method according to claim 1, comprising treating said never-dried fibre with an aqueous emulsion of a second polymer simultaneously with or subsequently to the step of treating said fibre with said aqueous solution or dispersion.

8. A method according to claim 7, wherein said second polymer is a non-ionic polymer.

9. A method according to claim 8, wherein said second polymer is polyethylene.

10. A method according to claim 7, wherein said emulsion contains less than 1 per cent by weight of said second polymer.

11. A method according to claim 7, wherein the value of the pH of said emulsion is from 4 to 7.

12. A method according to claim 7, comprising treating said never-dried fibre with a mixture of said cationic polymer and said second polymer.

13. A method according to claim 7, comprising treating said never-dried fibre sequentially with said cationic polymer and said second polymer.

14. A method according to claim 7, wherein said fibre is so treated as to deposit 0.75 to 2.0 per cent by weight of said second polymer on said fibre.

* * * * *

UNITED STATES PATENT AND TRADEMARK OFFICE

CERTIFICATE OF CORRECTION

PATENT NO. : 5,520,869

DATED : May 28, 1996

INVENTOR(S) : James M. Taylor

It is certified that error appears in the above-indentified patent and that said Letters Patent is hereby corrected as shown below:

Col. 10, line 11, claim 6, delete "1" and insert thereof -- 2 --.

Signed and Sealed this

Twentieth Day of August, 1996

Bruce Lehman

*Attest:*

BRUCE LEHMAN

*Attesting Officer*

*Commissioner of Patents and Trademarks*